US007767126B2

(12) United States Patent
Kang et al.

(10) Patent No.: US 7,767,126 B2
(45) Date of Patent: Aug. 3, 2010

(54) EMBOSSING ASSEMBLY AND METHODS OF PREPARATION

(75) Inventors: Gary Yih-Ming Kang, Fremont, CA (US); John Hanan Liu, Mountain View, CA (US); Yi-Shung Chaug, Cupertino, CA (US)

(73) Assignee: SiPix Imaging, Inc., Fremont, CA (US)

( * ) Notice: Subject to any disclaimer, the term of this patent is extended or adjusted under 35 U.S.C. 154(b) by 77 days.

(21) Appl. No.: 11/498,529

(22) Filed: Aug. 2, 2006

(65) Prior Publication Data

US 2007/0042129 A1 Feb. 22, 2007

Related U.S. Application Data

(60) Provisional application No. 60/710,477, filed on Aug. 22, 2005, provisional application No. 60/716,817, filed on Sep. 13, 2005, provisional application No. 60/772,261, filed on Feb. 10, 2006.

(51) Int. Cl.
*B29C 33/38* (2006.01)
*C08J 7/00* (2006.01)

(52) U.S. Cl. ..... 264/220; 264/132; 264/226; 205/122; 427/147; 425/385

(58) Field of Classification Search ..... 264/219–222, 264/226, 602, 643, 131, 132, 134, 227; 425/375, 425/385; 427/146, 147, 282, 510, 404; 205/96, 205/118, 120, 122, 129; 101/32; 156/209, 156/553, 567, 582; 492/1, 28, 37, 40
See application file for complete search history.

(56) References Cited

U.S. PATENT DOCUMENTS

| | | | | | |
|---|---|---|---|---|---|
| 3,239,441 | A | * | 3/1966 | Marosi | 205/642 |
| 3,637,468 | A | * | 1/1972 | Icxi et al. | 205/118 |
| RE28,068 | E | * | 7/1974 | Lemelson | 264/440 |
| 3,900,359 | A | * | 8/1975 | Bakewell | 156/242 |
| 3,936,545 | A | * | 2/1976 | Brill et al. | 427/343 |
| 3,986,939 | A | * | 10/1976 | Prest | 205/162 |

(Continued)

FOREIGN PATENT DOCUMENTS

JP 53119228 A * 10/1978

(Continued)

OTHER PUBLICATIONS

Allen, K. (Oct. 2003). Electrophoretics Fulfilled. *Emerging Displays Review: Emerging Display Technologies, Monthly Report-Oct. 2003*, 9-14.

(Continued)

*Primary Examiner*—Philip C Tucker
*Assistant Examiner*—Dimple N Bodawala
(74) *Attorney, Agent, or Firm*—Howrey LLP

(57) ABSTRACT

The invention is directed to an embossing assembly comprising an embossing sleeve having a three-dimensional pattern formed thereon, an expandable insert; and a drum over which said sleeve and said expandable insert are mounted. The present invention is also directed to a method for preparing an embossing drum or an embossing sleeve. The present invention is further directed to a method for controlling the thickness of a plating material over the surface of a drum or sleeve in an electroplating process.

21 Claims, 11 Drawing Sheets

U.S. PATENT DOCUMENTS

| | | | | | |
|---|---|---|---|---|---|
| 4,022,927 | A | * | 5/1977 | Pfeiffer et al. | 430/5 |
| 4,077,864 | A | * | 3/1978 | Vanderveer et al. | 204/285 |
| 4,741,988 | A | * | 5/1988 | Van der Zande et al. | 430/312 |
| 4,923,572 | A | | 5/1990 | Watkins et al. | |
| 5,156,863 | A | | 10/1992 | Pricone et al. | |
| 5,177,476 | A | * | 1/1993 | DiSanto et al. | 345/107 |
| 5,200,253 | A | * | 4/1993 | Yamaguchi et al. | 428/195.1 |
| 5,281,325 | A | * | 1/1994 | Berg | 205/125 |
| 5,326,455 | A | * | 7/1994 | Kubo et al. | 205/77 |
| 5,327,825 | A | | 7/1994 | Parker et al. | |
| 5,436,034 | A | * | 7/1995 | Giesecke et al. | 427/508 |
| 5,460,922 | A | * | 10/1995 | Swirbel et al. | 430/315 |
| 5,483,890 | A | * | 1/1996 | Kildune | 101/401.1 |
| 5,744,013 | A | * | 4/1998 | Botts et al. | 204/242 |
| 5,759,378 | A | * | 6/1998 | Ferrier et al. | 205/159 |
| 5,776,327 | A | * | 7/1998 | Botts et al. | 205/96 |
| 5,834,037 | A | * | 11/1998 | Wu | 425/174.8 R |
| 5,881,444 | A | | 3/1999 | Schaefer et al. | |
| 6,006,415 | A | | 12/1999 | Schaefer et al. | |
| 6,027,631 | A | * | 2/2000 | Broadbent | 205/137 |
| 6,080,606 | A | * | 6/2000 | Gleskova et al. | 438/151 |
| 6,117,300 | A | * | 9/2000 | Carbin et al. | 205/125 |
| 6,132,583 | A | * | 10/2000 | Stone | 205/96 |
| 6,179,983 | B1 | * | 1/2001 | Reid et al. | 205/96 |
| 6,280,581 | B1 | * | 8/2001 | Cheng | 204/224 R |
| 6,402,923 | B1 | * | 6/2002 | Mayer et al. | 205/96 |
| 6,770,225 | B2 | * | 8/2004 | Nilsen et al. | 264/1.9 |
| 6,974,530 | B2 | * | 12/2005 | Bonkass et al. | 205/96 |
| 7,156,945 | B2 | | 1/2007 | Chaug et al. | |
| 2002/0125140 | A1 | * | 9/2002 | Uzoh et al. | 205/82 |
| 2003/0008489 | A1 | * | 1/2003 | Koblis | 438/612 |
| 2004/0245669 | A1 | * | 12/2004 | Nishi et al. | 264/219 |
| 2005/0023145 | A1 | * | 2/2005 | Cohen et al. | 205/118 |
| 2005/0121328 | A1 | * | 6/2005 | Shirakashi et al. | 205/96 |
| 2005/0239935 | A1 | * | 10/2005 | Kang et al. | 524/306 |
| 2006/0086620 | A1 | * | 4/2006 | Chase et al. | 205/164 |
| 2006/0142853 | A1 | * | 6/2006 | Wang et al. | 623/1.46 |
| 2007/0175762 | A1 | * | 8/2007 | Kang et al. | 205/81 |
| 2007/0181430 | A1 | * | 8/2007 | Cohen | 205/118 |

FOREIGN PATENT DOCUMENTS

| | | | | |
|---|---|---|---|---|
| JP | 62056125 | A | * | 3/1987 |
| JP | 03192213 | A | * | 8/1991 |
| WO | WO 2005002305 | A2 | * | 1/2005 |

OTHER PUBLICATIONS

Bardsley, J.N. & Pinnel, M.R. (Nov. 2004) Microcup™ Electrophoretic Displays. *USDC Flexible Display Report*, 3.1.2. pp. 3-12-3-16.

Chaug, Y.S., Haubrich, J.E., Sereda, M. and Liang, R.C. (Apr. 2004). Roll-to-Roll Processes for the Manufacturing of Patterned Conductive Electrodes on Flexible Substrates. *Mat. Res. Soc. Symp. Proc.*, vol. 814, I9.6.1.

Chen, S.M. (Jul. 2003) The Applications for the Revolutionary Electronic Paper Technology. *OPTO News & Letters*, 102, 37-41. (in Chinese, English abstract attached, full translation available upon request).

Chen, S.M. (May 2003) The New Applications and the Dynamics of Companies. *TRI*. 1-10. (In Chinese, English abstract attached, full translation availabe upon request).

Chung, J., Hou, J., Wang, W., Chu, L.Y., Yao, W., & Liang, R.C. (Dec. 2003). Microcup(R) Electrophoretic Displays, Grayscale and Color Rendition. *IDW*, AMD2/EP1-2, 243-246.

Ho, Candice. (Feb. 1, 2005) *Microcupt® Electronic Paper Device and Applicaiton*. Presentation conducted at USDC 4th Annual Flexible Display Conference 2005.

Ho, C.,& Liang, R.C. (Dec. 2003). *Microcup (R) Electronic Paper by Roll-to-Roll Manufacturing Processes*. Presentation conducted at FEG, Nei-Li, Taiwan.

Hou, J., Chen, Y., Li, Y., Weng, X., Li, H. And Pereira, C. (May 2004). Reliability and Performance of Flexible Electrophoretic Displays by Roll-to-Roll Manufacturing Processes. *SID Digest*, 32.3, 1066-1069.

Lee, H., & Liang, R.C. (Jun. 2003) SiPix Microcup(R) Electronic Paper—An Introduction. *Advanced Display*, Issue 37, 4-9 (in Chinese, English abstract attached, full translation available upon request).

Liang, R.C. (Feb. 2003) *Microcup(R) Electrophoretic and Liquid Crystal Displays by Roll-to-Roll Manufacturing Processes*. Presentation conducted at the Flexible Microelectronics & Displays Conference of U.S. Display Consortium, Phoenix, Arizona, USA.

Liang, R.C. (Apr. 2004). *Microcup Electronic Paper by Roll-to-Roll Manufacturing Process*. Presentation at the Flexible Displays & Electronics 2004 of Intertech, San Fransisco, California, USA.

Liang, R.C. (Oct. 2004) *Flexible and Roll-able Display/Electronic Paper—A Technology Overview*. Paper presented at the METS 2004 Conference in Taipie, Taiwan.

Liang, R.C., (Feb. 2005) *Flexible and Roll-able Displays/Electronic Paper—A Brief Technology Overview*. Flexible Display Forum, 2005, Taiwan.

Liang, R.C., Hou, J., Chung, J., Wang, X., Pereira, C., & Chen, Y. (2003). Microcup(R) Active and Passive Matrix Electrophoretic Displays by A Roll-to-Roll Manufacturing Processes. *SID Digest*, 20.1.

Liang, R.C., Hou, J., & Zang, H.M. (Dec. 2002) Microcup Electrophoretic Displays by Roll-to-Roll Manufacturing Processes. *IDW*, EP2-2, 1337-1340.

Liang, R.C., Hou, J., Zang, H.M., & Chung, J. (Feb. 2003). *Passive Matrix Microcup(R) Electrophoretic Displays*. Paper presented at the IDMC, Taipei, Taiwan.

Liang, R.C., Hou, J., Zang, H.M., Chung, J., & Tseng, S. (2003). Microcup(R) displays : Electronic Paper by Roll-to-Roll Manufacturing Processes. *Journal of the SID*, 11(4), 621-628.

Liang, R.C., Zang, H.M., Wang, X., Chung, J. & Lee, H., (Jun./Jul. 2004) << Format Flexible Microcup (R) Electronic Paper by Roll-to-Roll Manufacturing Process >>, Presentation conducted at the 14th FPD Manufacturing Technology Expo & Conference.

Liang, R.C., & Tseng, S. (Feb. 2003). *Microcup(R) LCD, An New Type of Dispersed LCD by A Roll-to-Roll Manufacturing Process*. Paper presented at the IDMC, Taipei, Taiwan.

Nikkei Microdevices. (Dec. 2002) Newly-Developed Color Electronic Paper Promises—Unbeatable Production Efficiency. *Nikkei Microdevices*, 3. (in Japanese, with English translation).

Wang, X., Kiluk, S., Chang, C., & Liang, R.C. (Feb. 2004). Mirocup (R) Electronic Paper and the Converting Processes. *ASID*, 10.1.2-26, 396-399, Nanjing, China.

Wang, X., Kiluk, S., Chang, C., & Liang, R.C., (Jun. 2004) Microcup® Electronic Paper and the Converting Processes. *Advanced Display*, Issue 43, 48-51.

Wang, X., Li, P., Sodhi, D., Xu, T. and Bruner, S. et al., (Feb. 2006) *Inkjet Fabrication of Multi-Color Microcup® Electrophorectic Display*. the Flexible Microelectronics & Displays Conference of U.S. Display Consortium.

Wang, X., Zang, HM., and Li, P. (Jun. 2006) Roll-to-Roll Manufacturing Process for Full Color Electrophoretic film. *SID Digest*, pp. 1587-1589.

Zang, H.M. (Feb. 2004). *Microcup Electronic Paper*. Presentation conducted at the Displays & Microelectronics Conference of U.S. Display Consortium, Phoenix, Arizona, USA.

Zang, H.M. (Oct. 2003). *Microcup (R) Electronic Paper by Roll-to-Roll Manufacturing Processes*. Presentation conducted at the Advisory Board Meeting, Bowling Green State University, Ohio, USA.

Zang, H.M.Hou, Jack, (Feb. 2005) *Flexible Microcup® EPD by RTR Process*. Presentation conducted at 2nd Annual Paper-Like Displays Conference, Feb. 9-11, 2005, St. Pete Beach, Florida.

Zang, H.M, Hwang, J.J., Gu, H., Hou, J., Weng, X., Chen, Y., et al. (Jan. 2004). Threshold and Grayscale Stability of Microcup (R) Electronic Paper. *Proceeding of SPIE-IS&T Electronic Imaging, SPIE* vol. 5289, 102-108.

Zang, H.M., & Liang, R.C. (2003) Microcup Electronic Paper by Roll-to-Roll Manufacturing Processes. *The Spectrum*, 16(2), 16-21.

Zang, HM., Wang, W., Sun, C., Gu, H., and Chen, Y. (May 2006) Monochrome and Area Color Microcup® EPDs by Roll-to-Roll Manufacturing Processes. *ICIS ' 06 International Congress of Imaging Science Final Program and Proceedings*, pp. 362-365.

International Search Report for PCT/US06/32251, mailed Apr. 4, 2008.

* cited by examiner

5A

5B

5C

EMBOSSING ASSEMBLY AND METHODS OF PREPARATION

This application claims the benefit of U.S. Provisional Application Nos. 60/710,477, filed Aug. 22, 2005; 60/716,817, filed Sep. 13, 2005; and 60/772,261, filed Feb. 10, 2006; the contents of which are incorporated herein by reference in their entirety.

BACKGROUND OF THE INVENTION

1. Field of the Invention

The invention is directed to an embossing assembly and methods for its preparation.

2. Description of Related Art

U.S. Pat. No. 4,923,572 (hereinafter referred to as the '572 patent) discloses a generally cylindrical image embossing tool that can be used for embossing a material on a web. The method for the manufacture of the image embossing tool involves multiple steps, including (1) placing an embossable material around the surface of a rigid cylinder, followed by coating a thin metal, such as silver, over it, (2) stamping a desired image or pattern onto the embossable layer with a stamper, (3) electroforming to form a nickel electroform on the outer surface of the embossable layer, (4) applying a reinforcement layer over the electroform, (5) removing the rigid cylinder; (6) stripping the embossable layer to form a plating mandrel, (7) forming a second electroform on the interior of the plating mandrel and (8) separating the plating mandrel from the second electroform. According to the '572 patent, multiple copies of the second electroform can be prepared in the same manner and then be placed over a carrier cylinder or a plurality of rollers to form an embossing tool to allow continuous embossing. This embossing tool and its manufacturing process, however, suffer several disadvantages. For example, the process requires the stamping surface of the stamper to have a curvature same as that of the embossable material on the rigid cylinder. This is difficult to accomplish in practice. Secondly, if there are defects on the stamper, the defects will be carried over to copies of the electroforms prepared from the same stamper. Thirdly, it is also difficult to achieve defect-free joint lines between two adjacent stamps.

U.S. Pat. No. 5,327,825 (hereinafter referred to as the '825 patent) discloses a method for making a die through embossing or microembossing. More specifically, the method involves embossing a pattern or design onto a silver layer coated on a cylindrical surface, via the use of a concave-shaped stamping surface which carries the pattern or design to be imparted onto the silver layer and has a radius matching the radius of the cylindrical surface. This microembossing step is carried out multiple times so that the die prepared from the method has a repeated pattern or design from the concave-shaped stamping surface. This method has disadvantages similar to those of the process of the '572 patent, e.g., difficulty in matching the curvature of the stamping surface and the cylindrical surface; repeated defects resulted from an imperfect stamping surface; and difficulty in achieving defect-free joint lines between adjacent stamps.

U.S. Pat. No. 5,156,863 (hereinafter referred to as the '863 patent) discloses a method for manufacturing a continuous embossing belt. The method involves combining a series of "masters" or "copies" in a cluster to provide a desired pattern in a fixture and an electroform strip made of the cluster. The embossing belt is formed after multiple electroforming steps starting from a master cluster fixture. One of the drawbacks of this method is the difficulty to generate individual masters or copies for the cluster with same thickness. Therefore, there will be height differences between adjacent masters or strips that will result in formation of defect lines on the final embossed product. In addition, it is also difficult to avoid damage on the sleeve-type mandrel and the shim during their separation, particularly when a complicated microstructure with a deep 3D profile is involved.

U.S. Pat. Nos. 5,881,444 and 6,006,415 disclose a method for forming print rolls bearing holograms. The hologram pattern is formed by laser etching on the surface of a photoresist coated on a piece of flat glass or metal substrate. Mother shim and subsequent sister shims are electroformed as a flat plate. Then, a sister shim is mounted on the print roll to obtain an embossing tool. The disadvantages of the method include formation of defective joint lines resulted from rolling and welding a flat shim to a cylinder, and the difficulty in the adjustment of concentricity of the sister shim and the print roll. If the shim and roll are not concentric, the embossing pressure will not be uniform which will produce embossed microstructures with poor fidelity.

SUMMARY OF THE INVENTION

The present invention is directed to an embossing assembly and methods for its manufacture.

The first aspect of the present invention is directed to a method for preparing an embossing drum or embossing sleeve having a three-dimensional pattern formed on its outer surface. The method, combining photolithography and deposition (e.g., electroplating, electroless plating, physical vapor deposition, chemical vapor deposition or sputtering deposition), produces an embossing drum or embossing sleeve which has no repeating defective spots, no defective joint lines and no separation defects because the three-dimensional pattern is formed directly on the drum or sleeve.

The second aspect of the present invention is directed to an embossing sleeve having a three-dimensional pattern formed on its outer surface which embossing sleeve may be used in an embossing assembly.

The third aspect of the present invention is directed to an embossing assembly which comprises an embossing sleeve having a three-dimensional pattern formed on its outer surface, an expandable insert and a drum having the embossing sleeve and the expandable insert mounted thereon.

The fourth aspect of the present invention is directed to electroplating mechanisms that can provide a uniform deposit thickness on an embossing drum or sleeve.

DETAILED DESCRIPTION OF THE INVENTION

I. Method for Formation of a Pattern on an Embossing Drum or Sleeve

Figure 1:
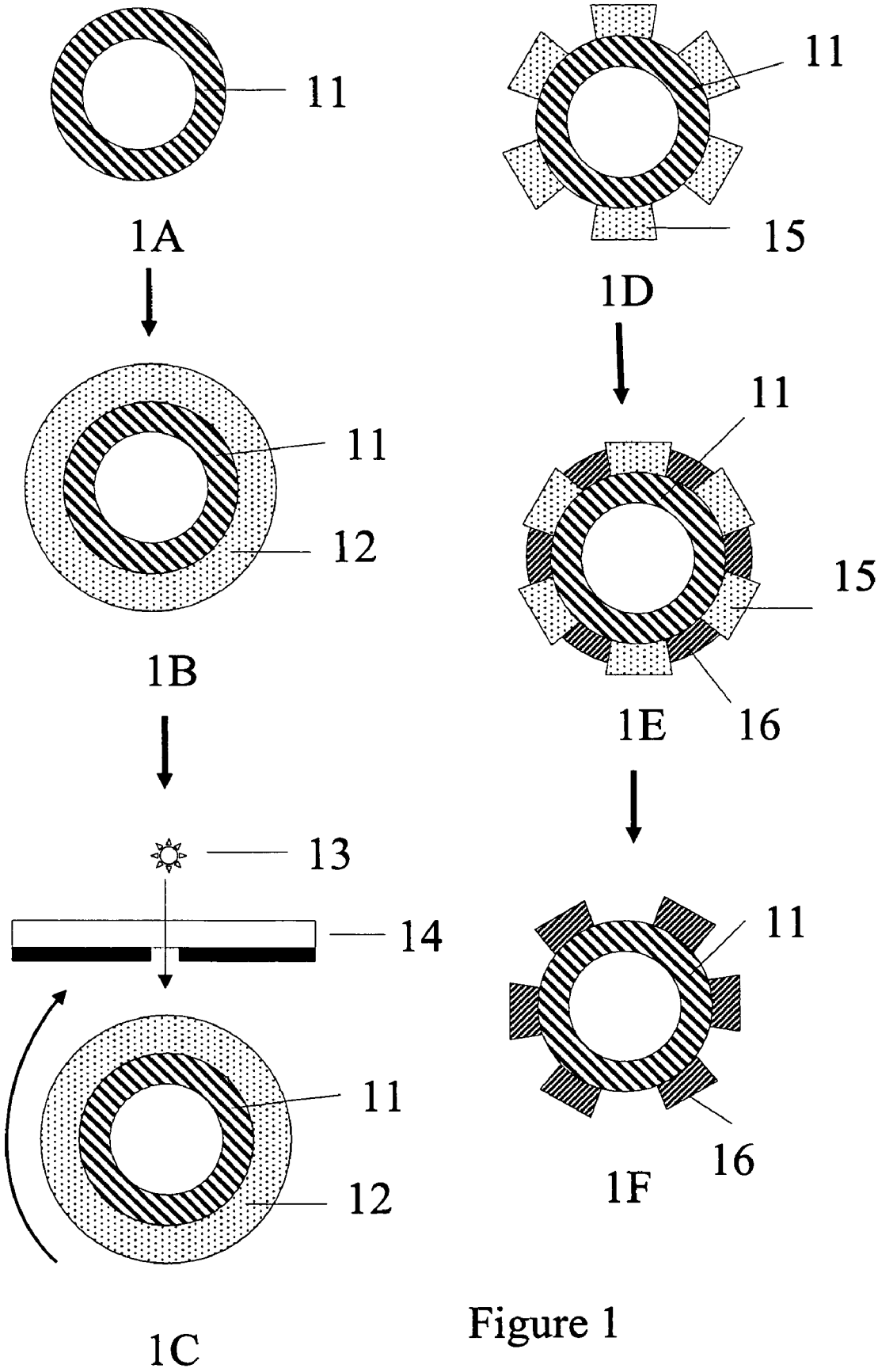
FIG. 1(A-F) illustrates a method for forming a three-dimensional pattern on an embossing drum or sleeve.

The method is illustrated in FIG. 1. The method produces embossing drums or sleeves which have a three-dimensional pattern formed on their outer surface.

While only the preparation of an embossing sleeve is demonstrated in FIG. 1, it is understood that the method can be used for the preparation of an embossing drum as well. The term "embossing" drum or "embossing" sleeve refers to drums or sleeves which have a three-dimensional pattern on their outer surface. The term "embossing drum" or "embossing sleeve" is used so as to distinguish it from a plain drum or a plain sleeve, which does not have a three-dimensional pattern on its outer surface. When the embossing drums or embossing sleeves are applied to a surface to be embossed, three-dimensional patterns complementary to the three-dimensional patterns on the outer surface of the embossing drums or embossing sleeves are formed on the embossed surface The embossing drum may be used directly as an embossing tool (also referred to as an embossing assembly). When the embossing sleeve is used for embossing, it is usually mounted on a plain drum to allow rotation of the embossing sleeve.

The embossing drum or embossing sleeve (11) is usually formed of a conductive material, such as a metal (e.g., aluminum, copper, zinc, nickel, chromium, iron, titanium, cobalt or the like), an alloy derived from any of the aforementioned metals, or stainless steel. Different materials may be used to form a drum or sleeve. For Example, the center of the drum or sleeve may be formed of steel and a nickel layer is sandwiched between the steel and the outermost layer which may be a copper layer.

Alternatively, the embossing drum or embossing sleeve (11) may be formed of a non-conductive material with a conductive coating or a conductive seed layer on its outer surface. Further alternatively, the embossing drum or embossing sleeve (11) may be formed of a non-conductive material without a conductive material on its outer surface.

Before coating a photosensitive material (12) on the outer surface of a drum or sleeve (11), as shown in the step of FIG. 1B, precision grinding and polishing may be used to ensure smoothness of the outer surface of the drum or sleeve.

In the step of FIG. 1B, a photosensitive material (12), e.g., a photoresist, is coated on the outer surface of the drum or sleeve (11). The photosensitive material may be of a positive tone, negative tone or dual tone. The photosensitive material may also be a chemically amplified photoresist. The coating may be carried out using dip, spray, drain or ring coating. The thickness of the photosensitive material is preferably greater than the depth or height of the three-dimensional pattern to be formed. After drying and/or baking, the photosensitive material is subjected to exposure as shown in FIG. 1C. Alternatively, the photosensitive material (12) can be a dry film photoresist (which is usually commercially available) that is laminated onto the outer surface of the drum or sleeve (11).

In the step of FIG. 1C, a suitable light source (13), e.g., IR, UV, e-beam or laser, is used to expose the photosensitive material (12) coated on the drum or sleeve (11). A photomask (14) is optionally used to define the three-dimensional pattern to be formed on the photosensitive material. Depending on the pattern, the exposure can be step-by-step, continuous or a combination thereof, the details of which are given below.

After exposure, the photosensitive material (12) may be subjected to post-exposure treatment, e.g., baking, before development. Depending on the tone of the photosensitive material, either exposed or un-exposed areas will be removed by using a developer. After development, the drum or sleeve with a patterned photosensitive material (15) on its outer surface (as shown in FIG. 1D) may be subjected to baking or blanket exposure before deposition (e.g., electroplating, electroless plating, physical vapor deposition, chemical vapor deposition or sputtering deposition).

A variety of metals or alloys (e.g., nickel, cobalt, chrome, copper, zinc, iron, tin, silver, gold or an alloy derived from any of the aforementioned metals) can be electroplated and/or electroless plated onto the drum or sleeve. The plating material (16) is deposited on the outer surface of the drum or sleeve in areas that are not covered by the patterned photosensitive material. The deposit thickness is preferably less than that of the photosensitive material, as shown in FIG. 1E. The thickness variation of the deposit over the whole drum or sleeve area can be controlled to be less than 1%, by adjusting plating conditions, e.g., the distance between the anode and the cathode (i.e., drum or sleeve) if electroplating is used, the rotation speed of the drum or sleeve and/or circulation of the plating solution.

Figure 2:
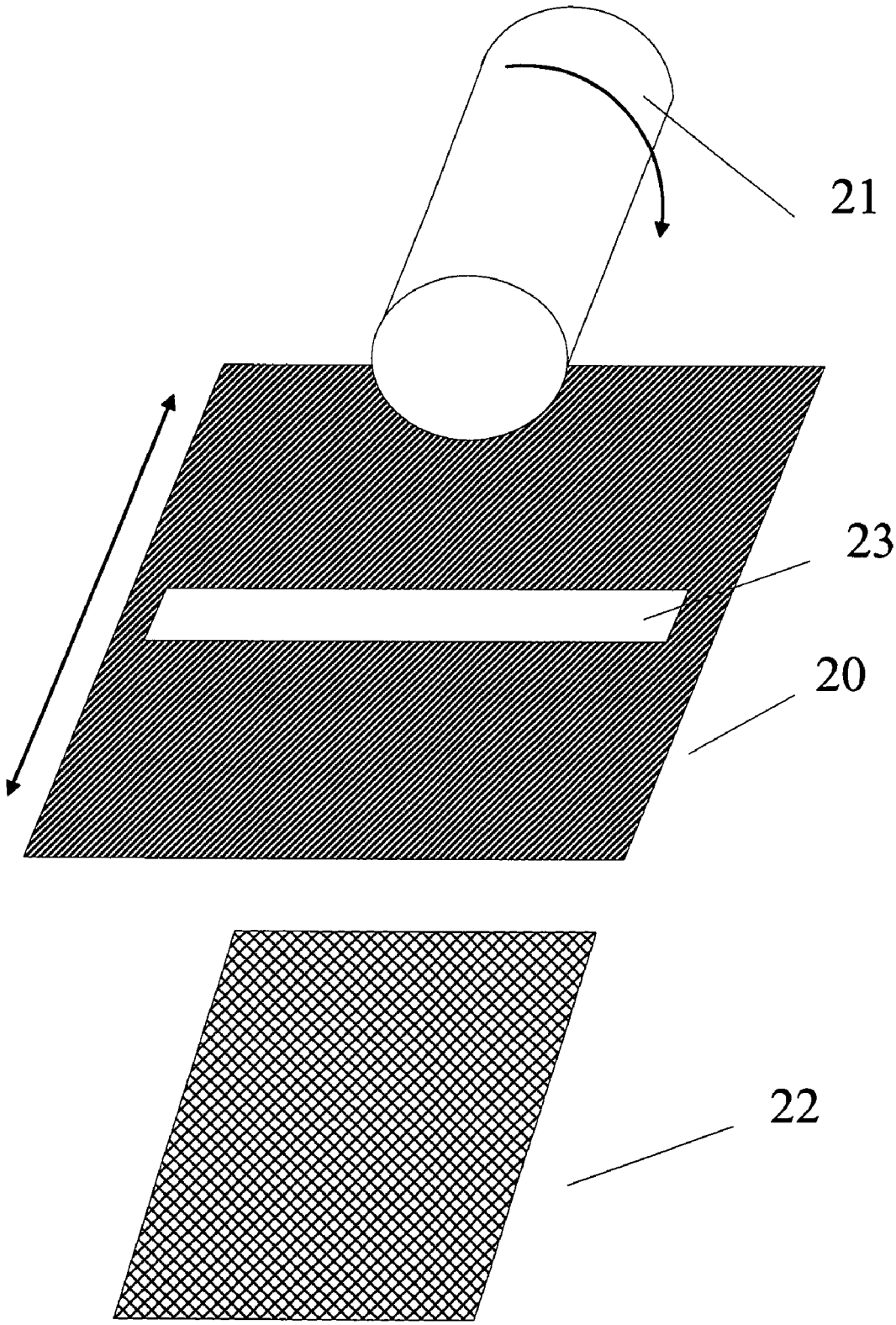
FIG. 2 shows an electroplating mechanism that includes a non-conductive thickness uniformer inserted between a cathode and an anode.

Alternatively, in the case of using electroplating to deposit the plating material (16), the thickness variation of the deposit over the entire surface of the drum or sleeve may be controlled by inserting a non-conductive thickness uniformer (20) between the cathode (i.e., the drum or sleeve) (21) and the anode (22), as shown in FIG. 2. The uniformer (20) may be of a flat or curved layer or of a circular shape (i.e., in the shape of a sleeve), depending on the layout of the cathode and the anode. The uniformer has a narrow opening or openings (23). During the electroplating step, the uniformer moves in the longitudinal direction of the drum or sleeve back and forth while the drum or sleeve rotates. Since the uniformer is formed of a non-conductive material, e.g., PVC (polyvinyl chloride), only the areas of the drum or sleeve that are directly exposed to the anode almost vertically through the openings (23) are electroplated. In other words, the outer surface areas of the drum or sleeve that are not covered by the patterned photosensitive material (15 in FIG. 1) continuously take turns to be electroplated. By using such a uniformer (20), the current distribution over the entire surface of the drum or sleeve is homogenized, thus ensuring a uniform deposit of the plating material.

Figure 3:
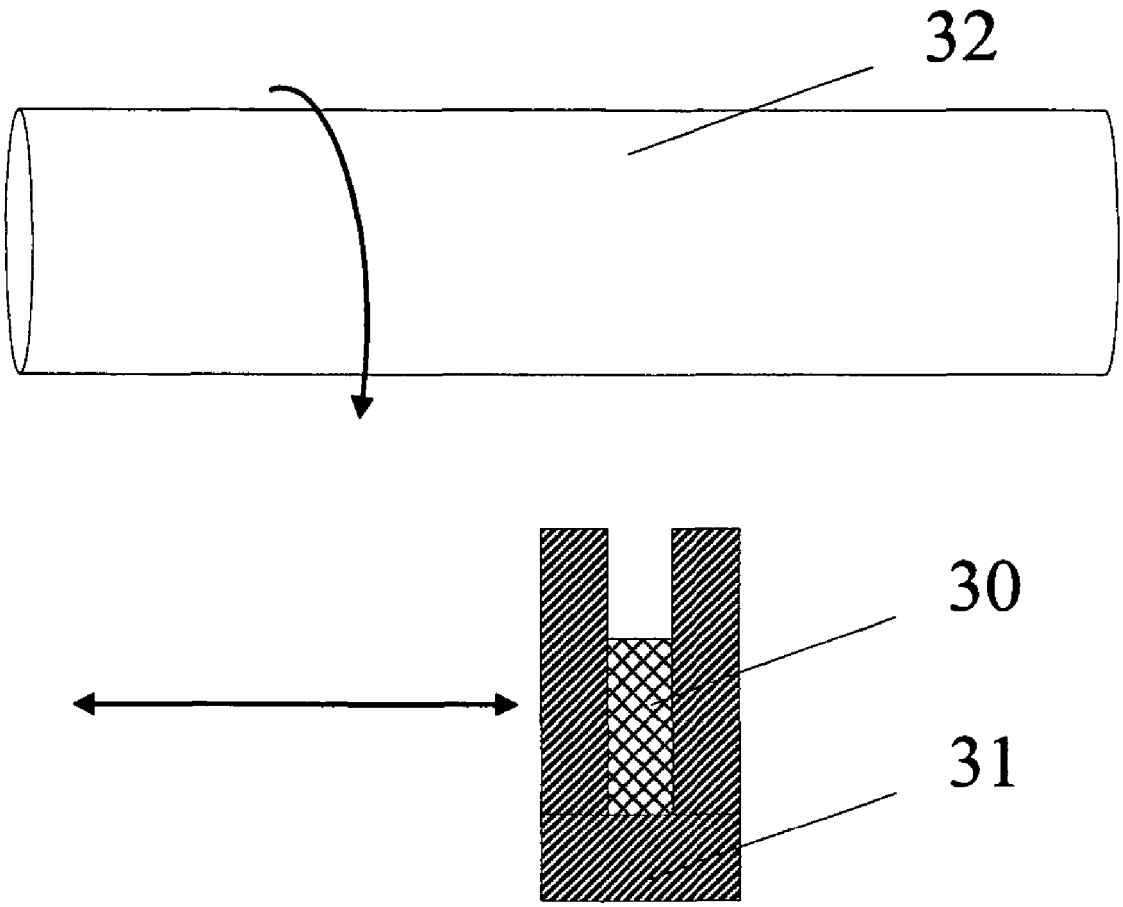
FIG. 3 shows an alternative electroplating mechanism that includes a small-sized anode.

Further alternatively, an anode (30) of a relatively small size as shown in FIG. 3 may be used to homogenize the deposit thickness. The anode is covered with a non-conductive material (31) except the side facing the cathode (i.e., the drum or sleeve) (32). Alternatively, only two sides of the anode are covered with the non-conductive material and in this case the side facing the cathode and its opposite side are not covered by the non-conductive material. During the electroplating step, the anode moves together with the non-conductive material in the longitudinal direction of the drum or sleeve back and forth while the drum or sleeve rotates. The anode may have a flat or curved side facing the cathode.

Figure 4:
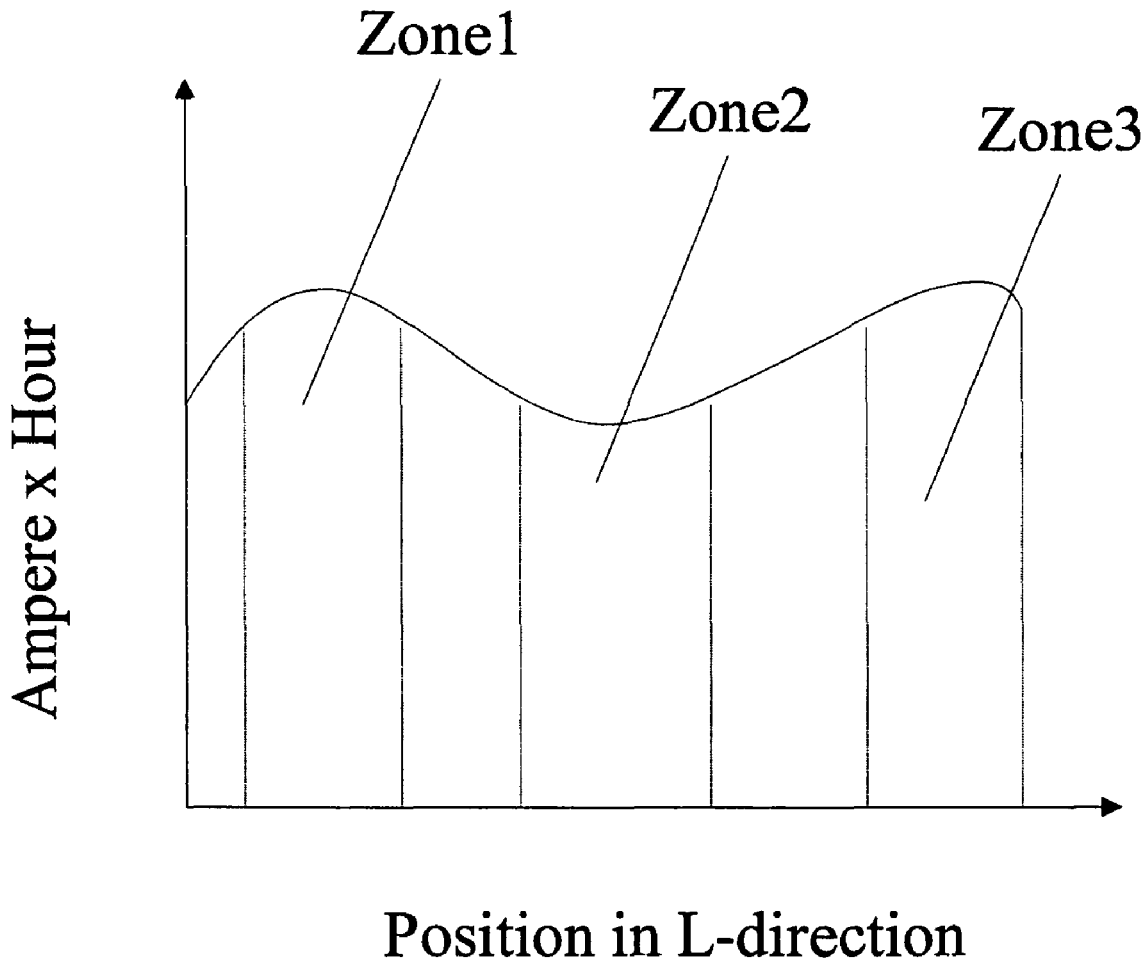
FIG. 4 illustrates a chart of amperexhour vs. position in the L-direction.

FIG. 4 shows a monitoring chart the data of which are received from an ampere-hour meter and an anode position gauge or transducer during electroplating. For the electroplating process, the value of the ampere-hour is proportional to the deposit thickness. The monitoring chart is continuously updated during electroplating; therefore the thickness uniformity over the entire drum or sleeve may be monitored in situ and adjusted, if necessary. For example, FIG. 4 indicates that the plated deposit in zone1 and zone3 is thicker than that of zone2. When such a situation is detected, the uniformer (20 in FIG. 2) or the anode (30 in FIG. 3) used in the two processes may be adjusted to move faster in zone1 and zone3 and/or to move slower in zone2 to homogenize the deposit thickness over the entire drum or sleeve.

It is understood that the plating can be carried out on a drum or sleeve that is made of a conductive material or a non-conductive material with a conductive coating or a conductive seed layer on its outer surface. For a non-conductive drum or sleeve, the three dimensional pattern may be prepared by a method combining photolithography and etching, the details of which are given below.

After plating, the patterned photosensitive material (15) can be stripped by a stripper (e.g., an organic solvent or aqueous solution).

A precision polishing may be optionally employed to ensure acceptable thickness variation and degree of roughness of the deposit over the entire drum or sleeve.

FIG. 1F shows a cross-section view of an embossing drum or embossing sleeve with a three-dimensional pattern formed thereon. If the plated material is relatively soft or susceptible to humidity, e.g., copper or zinc, a relatively wearable or inert layer, e.g., nickel or chrome, may be subsequently deposited. The deposition of the second layer may be carried out by electroplating, electroless plating, physical vapor deposition, chemical vapor deposition or sputtering deposition, over the entire outer surface of the drum or sleeve.

Alternatively, if the height (or thickness) of the three-dimensional pattern on the outer surface of an embossing drum or embossing sleeve is relative small, e.g., less than 1 microns, the plating step of FIG. 1E may be replaced by physical vapor deposition, chemical vapor deposition or sputtering deposition. The deposition is performed on the entire outer surface of the drum or sleeve. Since the deposit is so thin, the material deposited on top of the photosensitive material may be removed together with the photosensitive material in the stripping step.

Further alternatively, the embossing drum or embossing sleeve may be prepared by a method combining photolithography and etching instead of photolithography and deposition. After coating, exposing and developing (i.e., removal of selective areas of the photosensitive material) of a photosensitive material, an etching step is subsequently performed in areas not covered by the photosensitive material. The depth of etching may be controlled by the concentration of the etchant used, if a liquid type etchant is used (such as a ferric chloride solution to etch a copper drum or sleeve) or by etching flux intensity, if dry etching (chemical plasma etching, synergetic reactive ion etching or physical ion-beam etching) is used. The depth of etching may also be controlled by temperature and etching time. Alternatively, the depth of etching may be controlled to be uniform by using a selective etching method. For example, in such a method, a nickel layer is plated on the sleeve or drum first and then a copper layer with a desired thickness is plated on the top of the nickel layer. Since nickel will not be attacked by any of the copper etchants, e.g., ferric chloride, the etching depth can be well controlled. After the etching step, the remaining photosensitive material is removed by using a stripper, and subsequently a relatively wearable or inert layer, e.g., nickel or chrome, may be optionally deposited, as described above, over the entire outer surface of the drum or sleeve.

In practice, a three-dimensional pattern on the embossing drum or embossing sleeve prepared from the process as described above involving an additive (i.e., electroplating, electroless plating, physical vapor deposition, chemical vapor deposition or sputtering deposition) step would be structurally complementary to a three-dimensional pattern prepared from the process as described above involving a subtractive (i.e., etching) step.

Figure 5:
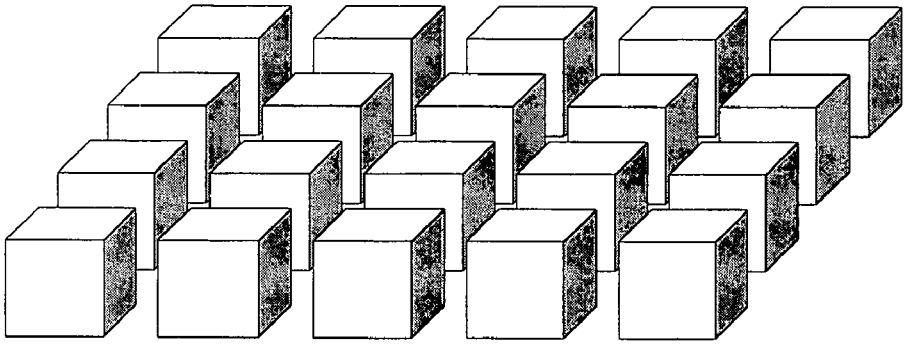
FIG. 5A shows an array of micro-posts on the outer surface of an embossing drum or sleeve.
FIG. 5B shows an array of micro-bars on the outer surface of an embossing drum or sleeve.
FIG. 5C illustrates a photomask which may be used in a stepwise or continuous exposure process.
Figure 5:
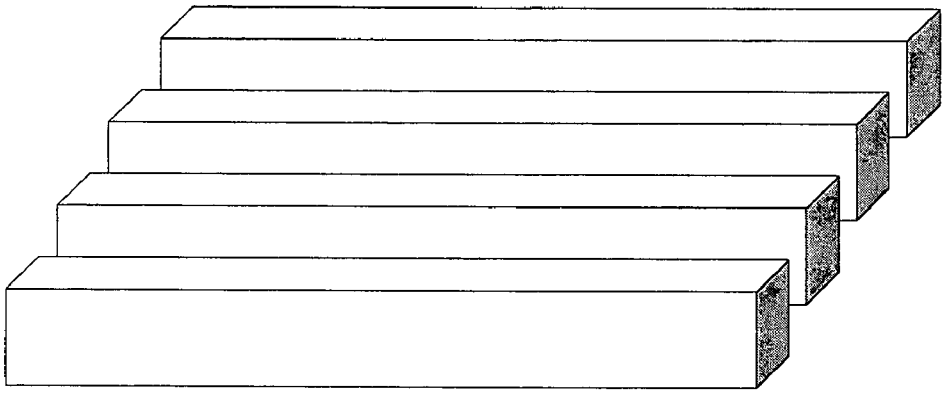
Figure 5:
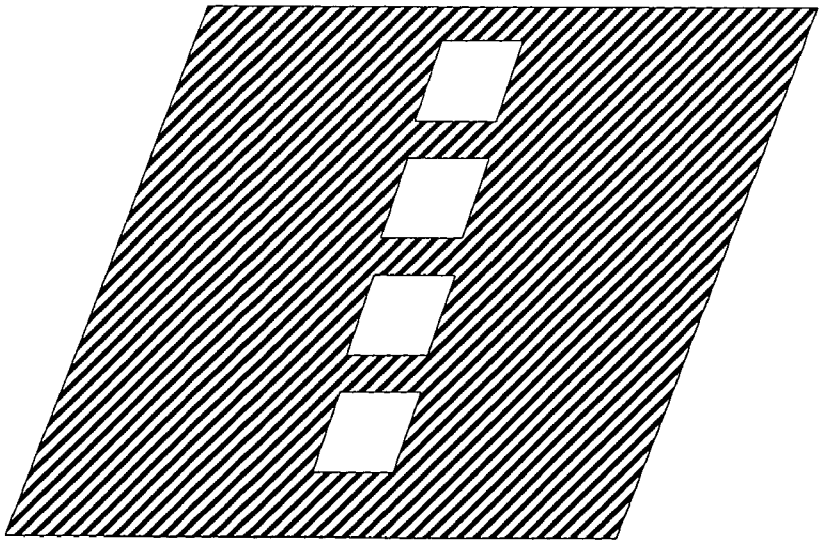

As mentioned above, the exposure step of FIG. 1C may be carried out step-by-step, continuous or a combination thereof. To simplify the drawings, the curvature of the outer surface of the drum or sleeve is not shown in FIGS. 5A and 5B. FIG. 5A shows an array of micro-posts on the embossing drum or embossing sleeve. To fabricate the micro-posts on the embossing drum or embossing sleeve, a photomask as shown in FIG. 5C may be used to stepwise expose the photosensitive material coated on the outer surface of the drum or sleeve. There are a number of ways for stepwise exposure.

Figure 6:
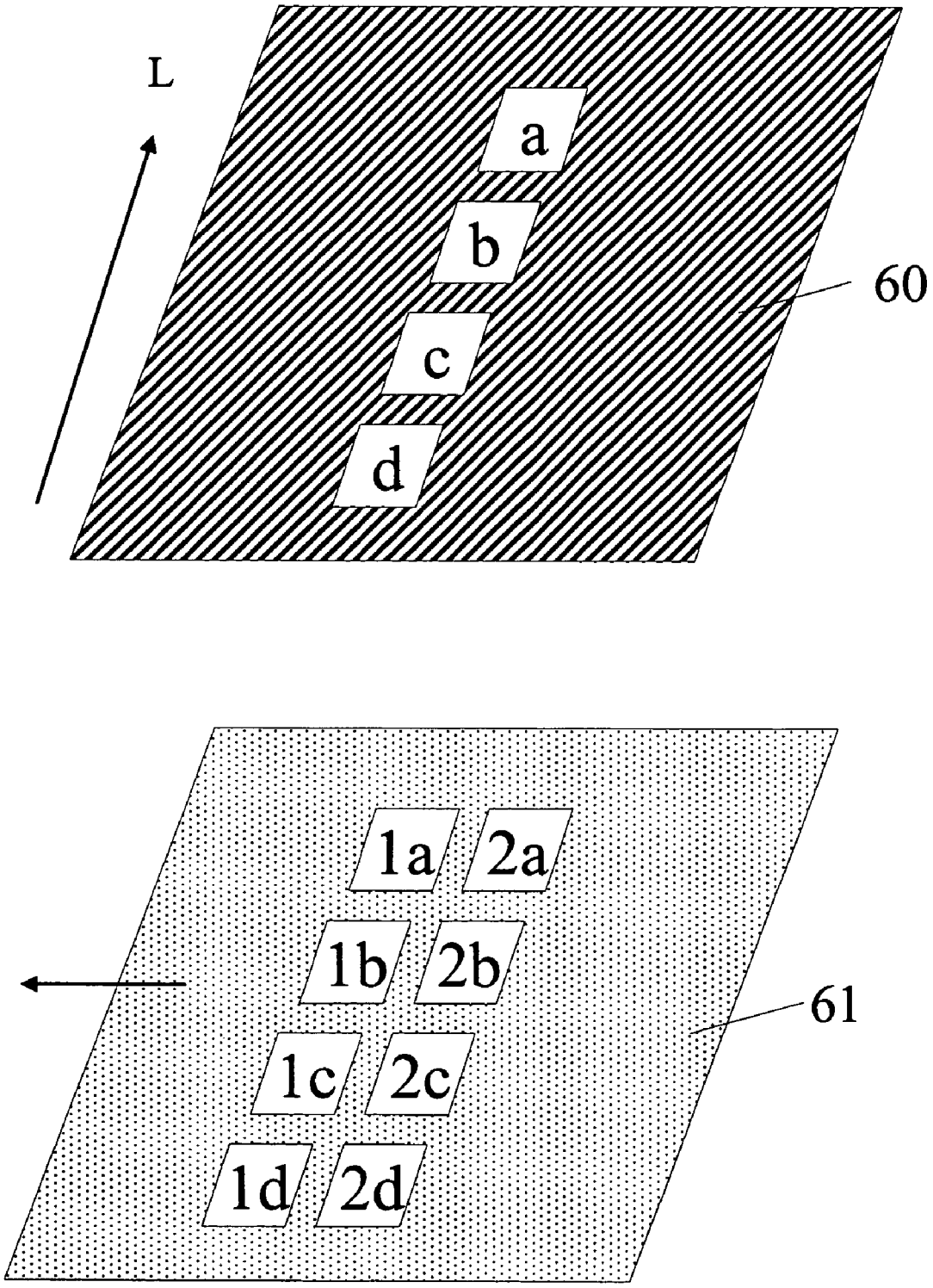
FIG. 6 shows stepwise exposure of a photosensitive material.

One of the methods involves the use of a pulse type light source. In this method as shown in FIG. 6, the photomask (60) remains stationary throughout the process. The drum or sleeve (not shown), however, rotates in a stop-and-go fashion. The exposure of the photosensitive material (61, curvature not shown) coated on the outer surface of the drum or sleeve, through the photomask occurs when the drum or sleeve is in the "stop" mode and the pulse type light source is on. As a result, the areas (1*a*)-(1*d*) on the photosensitive material are exposed corresponding to the openings (a)-(d) of the photomask. The drum or sleeve is then rotated to allow exposure of (2*a*)-(2*d*). However, during the interval when the drum or sleeve is moving (i.e., rotating) from the position where the openings (a)-(d) of the photomask are aligned with column 1 (i.e., (1*a*)-(1*d*)) to the position where the same openings of the photomask are aligned with column 2 (i.e., (2*a*)-(2*d*)), the pulse light source is off. Following the cycle of stop-and-go of the drum or sleeve in conjunction with the on and off states of the pulse light source, the photosensitive material is stepwise exposed.

If the light source can not cover the openings (a)-(d) of the photomask at the same time, scanning of the light source may be implemented for exposure while the pulse type light source is on.

Alternatively, a shutter may also be used to control the on and off states of the light source.

If the pattern on the drum or sleeve is parallel micro-bars as shown in FIG. 5B, the same photomask of FIG. 5C may be used for exposure. However, in this case, the exposure is continuous while the embossing drum or embossing sleeve is rotating.

While micro-posts and micro-bars are shown in the figures, it is understood that the three-dimensional pattern on the embossing drum or embossing sleeve may be of any shapes or sizes. A wide variety of sizes may be achieved for the elements (such as the micro-posts) on the three-dimensional pattern, ranging from sub-microns to much larger.

Figure 7A:
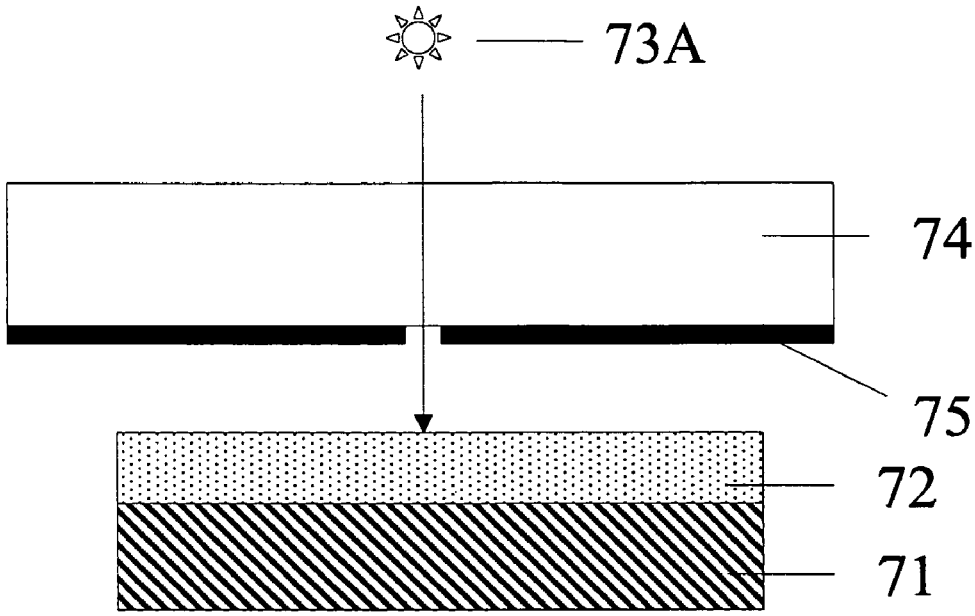
FIGS. 7A and 7B illustrate alternative light sources for the exposure process.
Figure 7B:
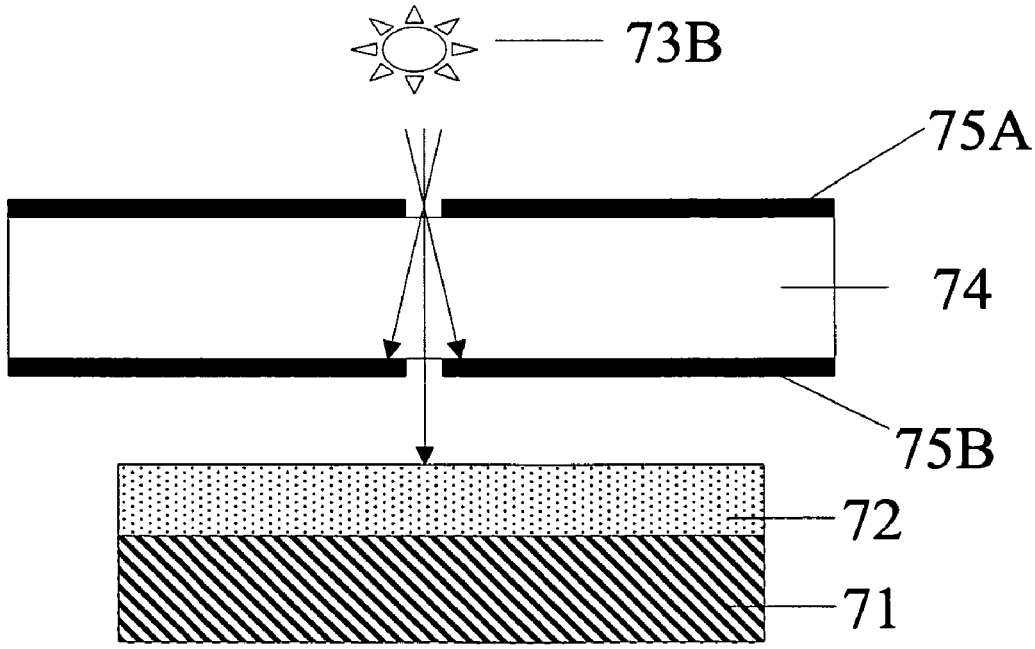

In addition to the methods mentioned above, there are several combinations of light source and photomask which may be used to more precisely control the dimension of the three-dimensional pattern. If a collimated light source (73A) (e.g., laser) is used for exposure as shown in FIG. 7A, an opaque patterned thin layer (75) (e.g., chrome) on one side of a transparent substrate (74) (e.g., glass) may be employed. If the shape and spot size of the collimated light source (73A) can be controlled by the combination of mirrors and lenses, there will be no need to use a photomask for exposure of the photosensitive material (72) coated on the drum or sleeve (71). If the light source (73B) is divergent, the transparent substrate (74) may be sandwiched between two opaque patterned thin layers (75A and 75B) to collimate the impinging light as shown in FIG. 7B. The photomask may also be made of a single opaque layer with suitable openings to allow the light to go through.

When the three-dimensional pattern is micro-posts, it is also possible to form the micro-posts on the outer surface of a drum or sleeve by "angled" exposure. In the case of micro-posts prepared by "angled exposure", the y axis of the micro-posts has a projection angle from the longitudinal axis (L) of the drum or sleeve. The projection angle (θ) is an oblique angle, preferably about 10° to about 80°, more preferably about 30° to about 60° and most preferably about 45°.

Figure 8A:
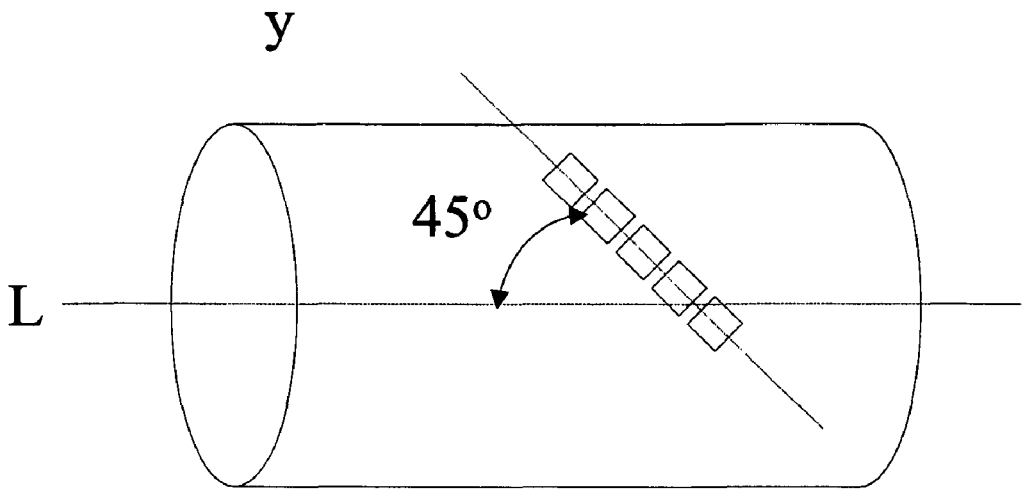
FIG. 8A shows an embossing drum or embossing sleeve having micro-posts on its outer surface, where the y-axis of the micro-posts has a projection angle of 45° from the longitudinal axis of the drum or sleeve.
Figure 8B:
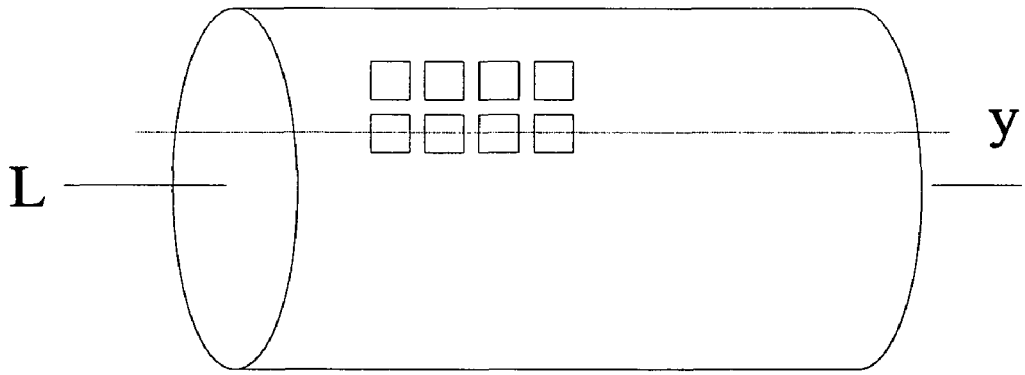
FIG. 8B shows an embossing drum or embossing sleeve having micro-posts on its outer surface, where the y-axis of the micro-posts has a 0° projection angle from the longitudinal axis of the drum or sleeve.

FIG. 8A shows micro-posts having a projection angle of 45°. In contrast, FIG. 8B shows micro-posts having a projection angle of 0° (i.e., the y axis of the micro-posts is parallel to the longitudinal axis of the drum or sleeve).

Figure 8C:
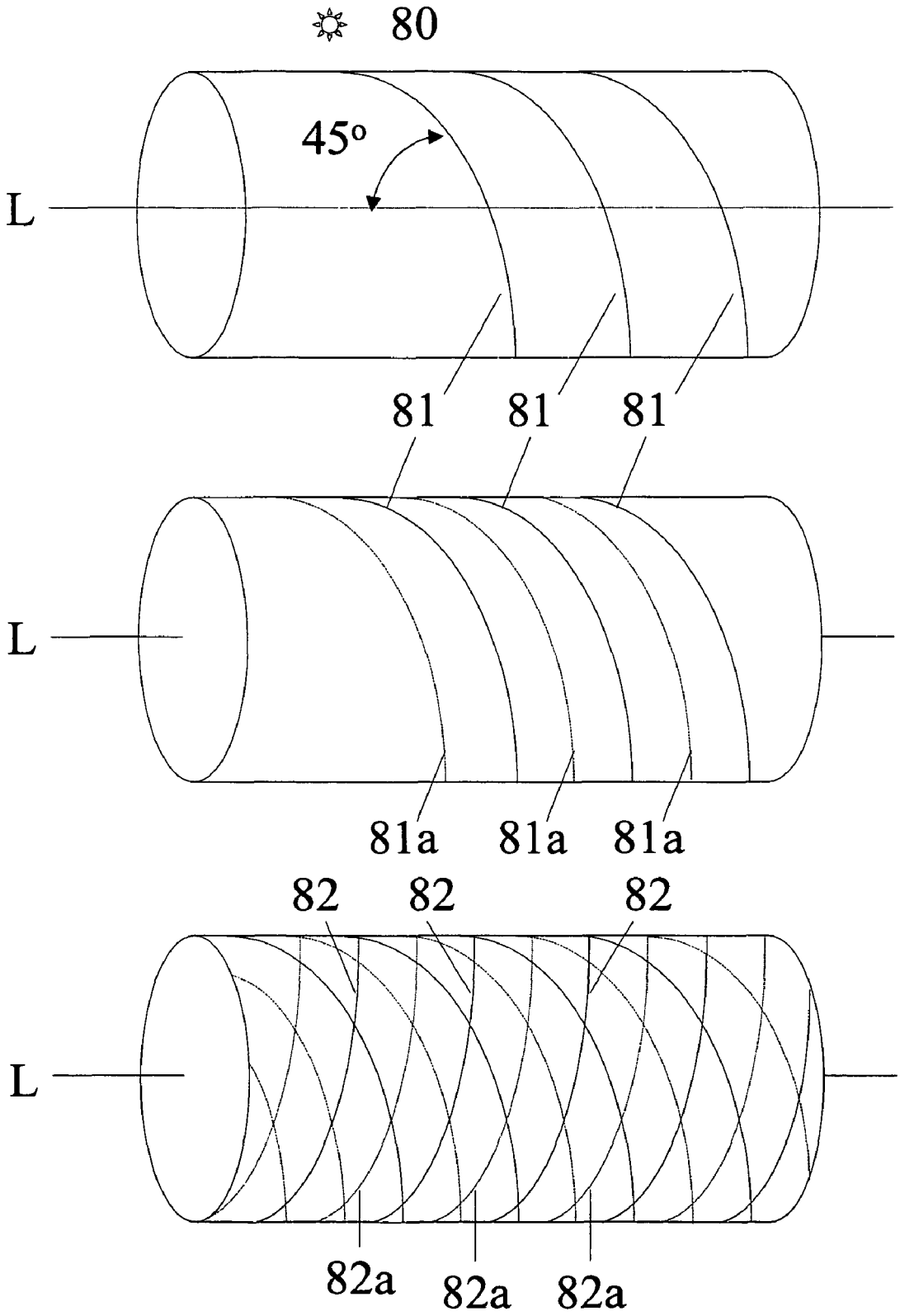
FIG. 8C illustrates angled exposure of a photosensitive material.

The angled exposure is illustrated in FIG. 8C. In the figure, a continuous spiral line (81) is formed on a photosensitive material coated on the outer surface of a drum or sleeve via exposure of the photosensitive material to a light source (80). The photosensitive material is preferably of a negative tone. When a photosensitive material of a negative tone is used, the subsequent step of developing the photosensitive material will remove the areas which are not covered by the spiral line. In other words, the area of the spiral line corresponds to the groove between the micro-posts eventually formed. Therefore, the width of the spiral line (81) should be substantially equal to the width of the grooves between the micro-posts.

In contrast to the formation of micro-posts having protruding elements by "angled exposure", it is also possible to form micro-cavities by using a photosensitive material of a positive tone. When a photosensitive material of a positive tone is used, the step of developing the photosensitive material will remove the areas which are covered by the spiral lines. In other words, the areas of the spiral lines correspond to the partition walls between the cavities eventually formed on the embossing drum or embossing sleeve.

It should be noted that the steps of FIGS. 1E and 1F may be modified. In some cases, the thickness of the plating material (16) may exceed the height of the photosensitive material (15). In such a case, the top area of the plating material beyond the photosensitive material may be wider than the bottom area because in the top area there is no photosensitive material to limit the width of the plating material. A structure prepared from such a method is useful for other applications, such as cell wells on a gravure cylinder to transfer printing ink to a substrate.

As an example, the continuous spiral line (81) in FIG. 8C has a 45° projection angle from the longitudinal axis (L) of the drum or sleeve. In one of the methods for forming the spiral line, the light source (80) steadily moves in the direction of the longitudinal axis (either left to right or right to left) of the drum or sleeve and the drum or sleeve simultaneously rotates (either clockwise or counter clockwise). In an alternative method, the exposure can be accomplished by moving the drum or sleeve in the direction of the longitudinal axis of the drum or sleeve and simultaneously rotating the drum or sleeve while the light source (80) is kept stationary. In a further alternative method, the light source may be rotating around the sleeve or drum while the drum or sleeve moves in the direction of the longitudinal axis.

For the formation of the second or subsequent spiral line (81*a*) in the same direction, the starting point of exposure is shifted one pitch distance away from the previous spiral line (81) already exposed. After all the spiral lines in one direction are exposed, the spiral lines (82 and 82*a*) in an opposite direction (minus 45° from the longitudinal axis of the drum or sleeve) are formed by exposure in a manner similar to the process for the exposure of lines 81 and 81*a*, except that the light source or the drum or sleeve moves in an opposite direction during exposure. The lines 82 and 82*a* are perpendicular to the lines 81 and 81*a*.

As an example, the spiral lines 81 and 81*a* may be exposed by moving the light source in one direction, left to right, at a certain speed and simultaneously rotating the drum or sleeve, counter clockwise, at a certain speed and the spiral lines 82 and 82*a* may then be exposed by changing the moving direction of the light source (from "left to right" to "right to left"); but maintaining the same rotation direction of the drum or sleeve (counter clockwise). Alternatively, the spiral lines 82 and 82*a* may be exposed by changing the rotation direction of the drum or sleeve (from counter clockwise to clockwise); but maintaining the moving direction of the light source (left to right).

In the above process, if the spot size of light source is smaller than the width of the grooves between adjacent micro-posts, the spiral lines may be exposed by several overlapping light scans. If the spot size of light source is larger than the width of the grooves, a photomask may be needed to confine the exposure.

In any case, if a photomask is used, the movement of the photomask must be synchronized with the movement of the light source.

An embossing drum or embossing sleeve having micro-posts prepared by angled exposure has the advantage that the angle assists the flow of the embossable composition used in the embossing process, thus eliminating trapped air on cross web directions.

Figure 9:
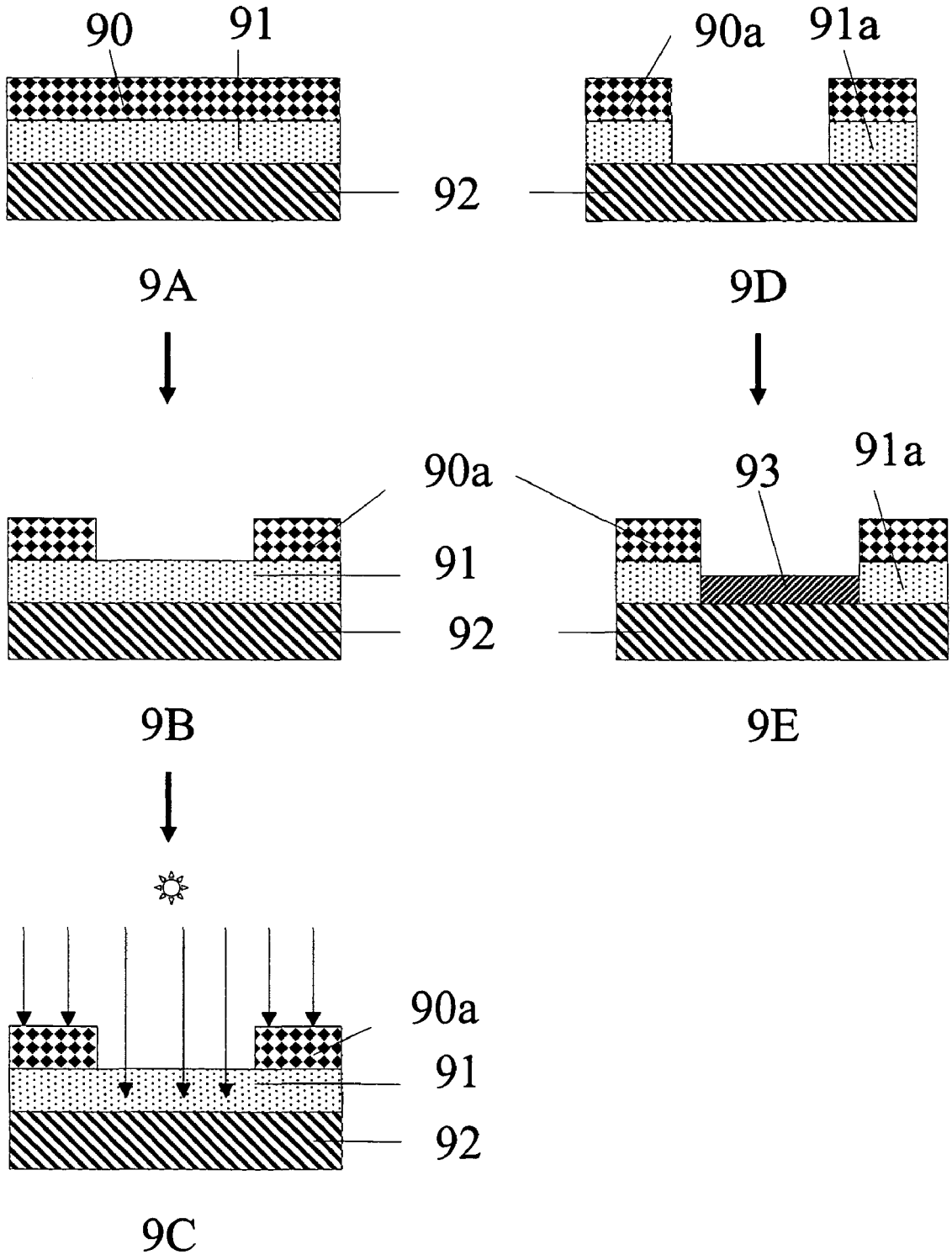
FIG. 9 shows a photolithography method using a mask material.

In addition to using a single layer of a photosensitive material as mentioned above, an additional layer of a mask material (90) may be placed over the photosensitive material (91), as shown in FIG. 9A, by using ring coating, drain coating, spray coating, physical vapor deposition, chemical vapor deposition or sputtering deposition. The photosensitive material (91) is coated over the surface (92) of the drum or sleeve (curvature not shown). The mask material may also be a photosensitive material that, on the one hand, can be imaged by using a light source with a wavelength different from that needed for the exposure of the photosensitive material (91), and on the other hand, has a high optical density at the wavelength range used to expose the photosensitive material (91). After exposing and developing of the mask material, the patterned mask material (90*a*) serves as a photomask to expose the photosensitive material (91) underneath. A silver-halide coating and an i-line photoresist may be used together as the mask material (90) and the photosensitive material (91), respectively. The silver-halide coating can be imaged using a laser diode with a wavelength of 670 nm, and the i-line photoresist can only be imaged using UV light with a wavelength of 365 nm. After exposure and development, the silver-halide coating is transferred to a patterned metallic silver layer that is opaque and can be used as a photomask for the exposure of the i-line photoresist underneath. Alternatively, the mask material may be a laser ablatable material (90 in FIG. 9A) that includes a polymeric matrix having a carbon pigment and an ultraviolet absorbing dye. The patterned ablatable material (90*a*) is used as a photomask for the exposure of the photosensitive material (91) underneath. The examples of possible materials useful for the process are disclosed in U.S. Pat. No. 6,828,067, the content of which is incorporated herein by reference in its entirety. After the development of the photosensitive material, a plating material (93) is deposited on the outer surface of the drum or sleeve in areas that are not covered by the patterned photosensitive material (91*a*).

In some instances, a barrier layer may be coated between the photosensitive material (91) and the mask material (90). The purpose of the barrier layer is to avoid the possible attack on the photosensitive material (91) by the solvent in the mask material (90) during the coating process. For instance, a layer of PVOH (polyvinyl alcohol) that is water-soluble may be used as a barrier layer to prevent the attack of the mask material on the photosensitive material, because the solvent in the mask material solution is not miscible with PVOH. In this case, the solvent in the mask material cannot penetrate the barrier layer to attack the photosensitive material.

II. Embossing Sleeve

When the embossing sleeve is used for embossing, it is usually mounted on a plain drum to allow rotation of the sleeve. Therefore the embossing sleeve preferably has an inside diameter which is slightly larger than the outside diameter of the plain drum in order to allow the sleeve to be mounted on the drum.

The fact that the 3-dimensional pattern is formed on an embossing sleeve has many advantages over having the pattern directly formed on an embossing drum. First of all, the sleeve is much lighter than a drum, only about one tenth or less of the weight of a drum; therefore it is much easier to handle. Secondly, there may be electrical heating coil or fluidic heating tube inside an embossing drum in order to provide a suitable high temperature to the surface of the embossing drum when it is used for embossing. If the three-dimensional pattern is formed directly on the outer surface of the embossing drum, the electrical heating coil or fluidic heating tube would need to be protected during preparation of the embossing drum. Another advantage of using an embossing sleeve is that different sleeves may be fitted to be used on the same plain drum, which effectively reduces the number of drums required, thus saving manufacturing costs.

The thickness of the embossing sleeve preferably may range from 1 mm to 100 mm, more preferably from 3 mm to 50 mm.

When an embossing sleeve is used for embossing, the sleeve must be snugly fitted over the plain drum. The tight fitting may be accomplished by pressure fit involving different materials having different thermal expansion coefficients. Alternatively, the tight fitting may be accomplished by mechanical taper fit.

III. Embossing Assembly

Figure 10A:
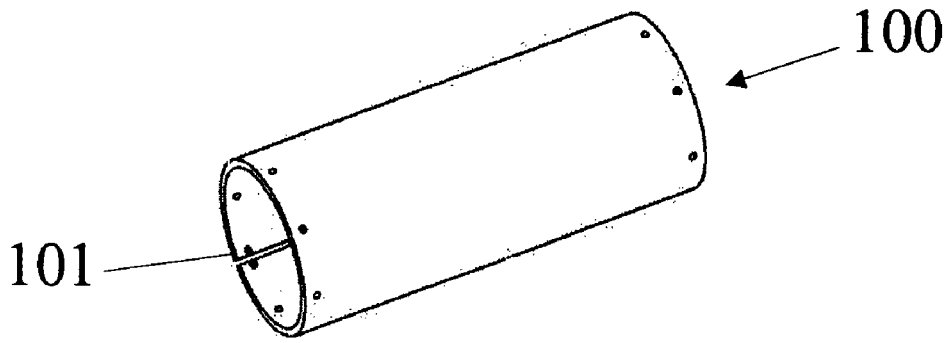
FIGS. 10A and 10B show expandable inserts.
Figure 10B:
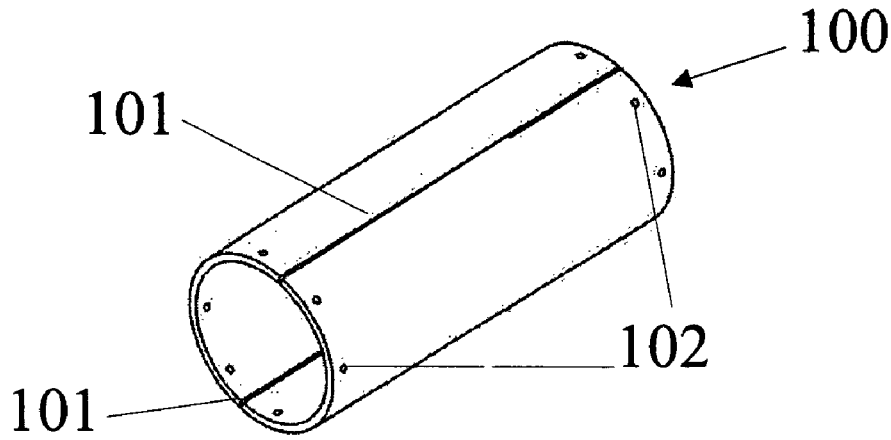

An expandable insert may be used to ensure tight fitting and concentricity between an embossing sleeve and a drum. FIGS. 10A and 10B illustrate such an expandable insert (100). The insert is a layer of a circular shape which may have one or multiple gaps (101) as shown in the figures. At both ends of the insert, there are tightening means (102), such as screws, to secure the insert over the drum. By tightening or loosening the screws, the diameter of the insert may be adjusted to ensure tight fitting of the embossing sleeve over the insert and simultaneously the concentricity of the embossing sleeve over the drum. For best results, there are at least 3 screws spreading around the circle, preferably having an equal distance between each other.

The insert is formed of a material, such as a metal (e.g., aluminum, copper, zinc, nickel, iron, titanium, cobalt or the like), an alloy or metal oxide derived from the aforementioned metals or stainless steel. If the insert material is relatively susceptible to humidity or chemical, e.g., copper or iron, a relatively inert layer may be employed to protect it. The deposition of the inert material may be carried out by electroplating, electroless plating, physical vapor deposition, chemical vapor deposition or sputtering deposition, over the entire surface of the insert. Alternatively, the insert may be formed of a plastic material, e.g., PVC (polyvinyl chloride) or ABS (acrylonitrile butadiene styrene).

The thickness of the expandable insert preferably may range from 1 mm to 100 mm, more preferably from 3 mm to 50 mm.

Figure 10C:
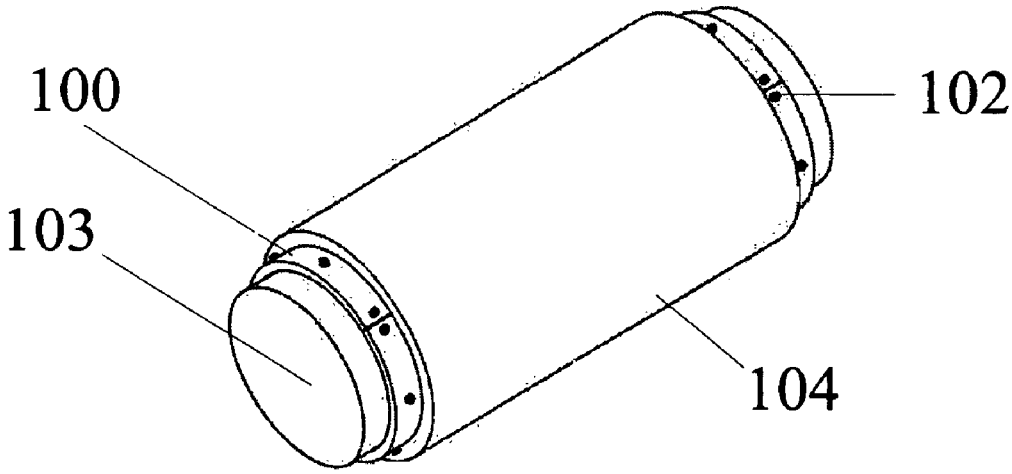
FIG. 10C illustrate an embossing assembly of the present invention in a three-dimensional view.

The insert (100) is placed between a plain drum (103) and an embossing sleeve (104) as shown in FIG. 10C. The insert (100) and the sleeve (104) may be sequentially mounted onto the drum (103). As also shown in FIG. 10C, the embossing sleeve is shorter than the insert so that the sleeve will not cover the areas on the insert where the screws (102) are present.

The expansion of the insert is controlled by the adjustment of screws (102), preferably with a torque wrench, to ensure proper tightness of the screws. When the screws are tightened (i.e., screwed down), the insert will expand to cause more contact between the inner surface of the sleeve and the outer surface of the insert, thus tightly holding the sleeve in position. The tightness of all of screws must be carefully oriented so that the concentricity of the embossing sleeve over the plain drum (103) may be simultaneously maintained. As explained earlier, the concentricity of the embossing sleeve over the plain drum is critically important to the quality of the embossed microstructures prepared from the embossing assembly.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. Accordingly, the present embodiments are to be considered as illustrative and not restrictive, and the invention is not to be limited to the details given herein, but may be modified within the scope and equivalents of the appended claims.

What is claimed is:

1. A method for preparing an embossing assembly, which method comprises:

a) coating or laminating a photosensitive material over the outer surface of a sleeve;

b) selectively exposing the photosensitive material;

c) removing the photosensitive material either in areas that are exposed or in areas that are not exposed;

d) depositing a metal or alloy onto the outer surface of the sleeve where there is no photosensitive material present;

e) removing the photosensitive material remaining between the metal or alloy to form an embossing sleeve; and f) mounting said embossing sleeve over a drum with an expandable insert between said embossing sleeve and said drum.

2. The method of claim 1 wherein said photosensitive material in step (a) is of a positive tone, negative tone or dual tone.

3. The method of claim 1 wherein said photosensitive material is a chemically amplified photoresist.

4. The method of claim 1 wherein said exposing of step (b) is carried out stepwise or continuous.

5. The method of claim 1 wherein said exposing of step (b) is carried out by IR, UV, e-beam or laser.

6. The method of claim 1 wherein said metal or alloy is nickel, cobalt, chrome, copper, zinc, iron, tin, silver, gold or an alloy derived therefrom.

7. The method of claim 1 wherein step (e) is carried out by a stripper.

8. The method of claim 1 wherein step (b) is carried out by coating a mask material over the photosensitive material, patterning the mask material to form a patterned mask material and exposing the photosensitive material through the patterned mask material.

9. The method of claim 8 wherein said patterning is carried out by photolithography or ablation.

10. The method of claim 1 further comprising inserting a non-conductive thickness uniformer between the sleeve and at least one anode wherein said uniformer has at least one opening;

moving the uniformer in a longitudinal direction of the sleeve back and forth and simultaneously rotating the sleeve; and directly exposing said metal or alloy on the outer surface of the sleeve to the anode through the opening of the uniformer.

11. The method of claim 1 further comprising:

providing at least an anode which is covered with a non-conductive material except the side lacing the sleeve or two opposite sides one of which is facing the sleeve; and moving the anode covered with the non-conductive material in a longitudinal direction of the sleeve back and forth and simultaneously rotating the sleeve.

12. The method of claim 10 further comprising monitoring and adjusting in situ the moving speed of the uniformer to homogenize the deposit thickness of the metal or alloy.

13. The method of claim 12 wherein the moving speed of the uniformer is adjusted based on the value amperex×hour, which is proportional to the deposit thickness.

14. The method of claim 11 further comprising monitoring and adjusting in situ the moving speed of the anode covered with the non-conductive material to homogenize the deposit thickness of the metal or alloy.

15. The method of claim 14 wherein the moving speed of the uniformer is adjusted based on the value of amperex×hour, which is proportional to the deposit thickness.

16. The method of claim 8 further comprising coating a barrier layer between the mask material and the photosensitive material.

17. The method of claim 1 wherein said expandable insert has multiple tightening means.

18. The method of claim 1 wherein said expandable insert is formed of a metal, an alloy, a metal oxide of said metal, or stainless steel.

19. The method of claim 18 wherein said metal is aluminum, copper, zinc, nickel, iron, titanium or cobalt.

20. The method of claim 1 wherein said expandable insert is protected with an inert material.

21. The method of claim 1 wherein said expandable insert is formed of a plastic material.

* * * * *